US012116865B2

(12) United States Patent
McNay

(10) Patent No.: US 12,116,865 B2
(45) Date of Patent: Oct. 15, 2024

(54) FLUID HEATER AND ASSOCIATED METHODS

(71) Applicant: Cavitas Energy Ltd, Aberdeen (GB)

(72) Inventor: Graeme William McNay, Bridge of Don (GB)

(73) Assignee: Cavitas Energy Ltd, Aberdeen (GB)

( * ) Notice: Subject to any disclaimer, the term of this patent is extended or adjusted under 35 U.S.C. 154(b) by 210 days.

(21) Appl. No.: 17/295,606

(22) PCT Filed: Nov. 22, 2019

(86) PCT No.: PCT/GB2019/053313
§ 371 (c)(1),
(2) Date: May 20, 2021

(87) PCT Pub. No.: WO2020/104819
PCT Pub. Date: May 28, 2020

(65) Prior Publication Data

US 2022/0018220 A1 Jan. 20, 2022

(30) Foreign Application Priority Data

Nov. 23, 2018 (GB) ..... 1819138

(51) Int. Cl.
*E21B 36/00* (2006.01)
*E21B 43/12* (2006.01)
*E21B 43/24* (2006.01)

(52) U.S. Cl.
CPC ..... *E21B 36/006* (2013.01); *E21B 43/128* (2013.01); *E21B 43/24* (2013.01)

(58) Field of Classification Search
CPC ..... E21B 43/24; E21B 43/128; E21B 36/006
See application file for complete search history.

(56) References Cited

U.S. PATENT DOCUMENTS

| | | | | |
|---|---|---|---|---|
| 3,396,806 | A * | 8/1968 | Benson | E21B 7/14 175/102 |
| 6,206,093 | B1 | 3/2001 | Lee et al. | |
| 9,670,761 | B2 * | 6/2017 | Hytken | E21B 43/126 |
| 2003/0155128 | A1 | 8/2003 | Gay et al. | |
| 2005/0045337 | A1 * | 3/2005 | Bansal | E21B 43/10 166/105 |
| 2007/0086902 | A1 | 4/2007 | Dooley | |

(Continued)

FOREIGN PATENT DOCUMENTS

| | | |
|---|---|---|
| RU | 2164597 C2 | 3/2001 |
| RU | 2657312 C1 | 6/2018 |

OTHER PUBLICATIONS

International Preliminary Report of Patentability for PCT/GB2019/053313 dated Jun. 3, 2021.

(Continued)

*Primary Examiner* — Blake Michener
*Assistant Examiner* — Yanick A Akaragwe
(74) *Attorney, Agent, or Firm* — Harness, Dickey & Pierce, P.L.C.

(57) ABSTRACT

Described examples relate to a downhole fluid heater, comprising a fluid heating assembly comprising a heating chamber for receiving a fluid. The fluid heating assembly is configured to agitate a heat transfer fluid in the heating chamber so as to impart thermal energy and heat the heat transfer fluid.

15 Claims, 6 Drawing Sheets

(56) References Cited

U.S. PATENT DOCUMENTS

| | | | | |
|---|---|---|---|---|
| 2009/0071646 | A1 | 3/2009 | Pankratz et al. | |
| 2009/0183879 | A1* | 7/2009 | Cox | E21B 43/121 166/302 |
| 2010/0000731 | A1* | 1/2010 | Gordon | E21B 49/08 166/264 |
| 2010/0288497 | A1* | 11/2010 | Burnham | E21B 43/24 166/57 |
| 2015/0129221 | A1 | 5/2015 | Mazyar et al. | |
| 2017/0356280 | A1* | 12/2017 | Sylvester | E21B 43/38 |
| 2018/0179873 | A1 | 6/2018 | Artinian et al. | |

OTHER PUBLICATIONS

Search Report for Intellectual Property Office Application No. GB1819138.7 dated Apr. 29, 2019.

International Search Report PCT/ISA/210 and Written Opinion of the International Searching Authority PCT/ISA/237 for International Application No. PCT/GB2019/053313 Dated Jan. 27, 2020.

* cited by examiner

FLUID HEATER AND ASSOCIATED METHODS

CROSS-REFERENCE TO RELATED APPLICATIONS

This application is a national phase under 35 U.S.C. § 371 of PCT International Application No. PCT/GB2019/053313, which has an International filing date of Nov. 22, 2019, which claims priority to Intellectual Property Office Application No. GB1819138.7, filed Nov. 23, 2018, the entire contents of each of which are hereby incorporated by reference.

TECHNICAL FIELD

Described examples relate to the field of fluid heaters, and in particular fluid heaters for use downhole and the like, as well as associated methods.

BACKGROUND

Significant innovation and advancements have occurred in recent years in relation to enhanced oil recovery, not only for unconventional reservoirs but also for mature fields or the like.

However, there is a continuing desire to ensure that the processes and apparatus used during enhanced oil recovery are safe, efficient and effective. For example, if the costs involved are significant, then those costs may outweigh any gains made in developing or maintaining particular fields.

This background serves only to set a scene to allow a skilled reader to better appreciate the following description. Therefore, none of the above discussion should necessarily be taken as an acknowledgement that that discussion is part of the state of the art or is common general knowledge. One or more aspects/examples of the disclosure may or may not address one or more of the background issues.

SUMMARY

There is described a fluid heater, such as a downhole fluid heater, and associated methods. Such a fluid heater may be for heating a fluid injected downhole. Such a fluid heater may be for injecting fluid downhole. Such a fluid heater may be for heating product (e.g. oil) downhole. Such a fluid heater may be for injecting fluid and heating product downhole (e.g. simultaneously). Such a fluid heater may be for heating a fluid to be injected or a product downhole, which is delivered to the fluid heater by a fluid delivery arrangement, for example by a fluid pump (e.g. a fluid pump at a surface of a wellbore, and/or a downhole fluid pump) or by an arrangement of fluid pumps. Although the fluid heater is described for use downhole, it should be understood that the fluid heater may also be used to heat fluid at a surface location, for example on the topsides of an oil platform. In this case, the fluid heater may be located in a container with the fluid to be heated, and subsequently pumped downhole.

Such heaters may help improve safety, while efficiently assisting with oil recovery, and being cost effective.

In some examples, the fluid heater comprises a fluid heating assembly. The heating assembly may comprise a heating chamber for receiving a heat transfer fluid. The fluid heating assembly may be configured to agitate fluid (e.g. mechanically agitate fluid) in the heating chamber so as impart thermal energy and heat that fluid. Such agitation may occur by a number of alternative mechanisms. The agitation of the fluid may comprise exerting a force on the fluid so as to cause cavitation of the fluid. The force exerted on the fluid may be, for example, a shearing force. The heat transfer fluid may be any appropriate fluid. For example, the heat transfer fluid may be an oil such as a viscous gear oil.

Such an assembly may comprise a first portion and a second portion arranged such that the first portion and the second portion define the heating chamber therebetween. At least one of the first portion and second portion may comprise surface features, for example, provided in the heating chamber.

The fluid heating assembly may be configured such that the first and second portions are movable relative to one another. Such relative movement may, in turn, cause relative movement of the surface features located in the heating chamber. As such, the fluid heating assembly, or indeed the first and second portions, may be configured to agitate fluid in the heating chamber. Such agitation may be used to impart thermal energy and heat the fluid. In other similar words, the fluid heating assembly may essentially be configured to covert mechanical energy into thermal energy, for example downhole (e.g. a specific location downhole).

The first portion may comprise surface features located on an external surface thereof, hereinafter referred to as a chamber surface, and the surface features referred to as chamber surface features. The second portion may comprise surface features located on an internal surface thereof. The second portion may comprise surface features located on an external surface thereof. The fluid heater may comprise surface features located on an external surface thereof, for example on the external surface of the second portion.

The surface features (e.g. the surface features located on an internal and/or external surface) may be configured to extend longitudinally along the surface (e.g. an internal and/or external surface) of the first and/or second portion. Alternatively or additionally, the surface features may be configured to extend transversally along the surface (e.g. the internal and/or external surface) of the first and/or second portion.

In some examples, the surface features may be considered to comprise one or more protrusions, extending from a surface (e.g. an internal and/or an external heat transfer surface) of the first and/or second portion.

The chamber surface features of the first portion may extend into the heating chamber (e.g. radially extend into the heating chamber). The surface features on the internal surface of the second portion may extend into the heating chamber (e.g. radially extend into the heating chamber).

The surface features located on the external surface of the second portion may extend radially (e.g. radially outwardly) from the external surface.

An end region of such protrusions may terminate at a flat or planar end region, a pointed end region or a curved end region (e.g. as a rounded end region).

The protrusions may comprise tapered sides, straight sides or curved sides. The protrusions may be elongate and/or may be arranged axially along the fluid heating assembly. In one example, the surface features, and indeed the protrusions, may be configured as a set of ribs extending along a surface of the first and/or second portion of the fluid heating assembly. The shape of the surface features may be selected to maximise the volume of fluid that is permissible to be held in the heating chamber. For example, having surface features on the first portion having straight sides and a flat end region may assist to maximise the volume of fluid that can be held in the heating assembly.

In the same or other examples, the surface features may comprise one or more depressions, extending from a surface of the first and/or second portion. An end region of such depressions may terminate in a flat or planar surface, a pointed or triangular convergence or a curved or filleted surface. The depressions may be elongate and/or may be arranged along the flow path. In some examples, the depressions may be considered to comprise one or more interstices, slots or grooves, extending from a surface of the first and/or second portion. In some examples, the slots or grooves may have a V-shape.

The surface features may comprise a combination of depressions and protrusions. In some examples, the surface features may comprise depressions that are defined between a plurality of protrusions (e.g. two).

The fluid heating assembly may be configured such that the first and second portions are rotatable relative to one another. In some examples, one of the first and second portions of the fluid heating assembly may be rotatable in order to provide relative movement. For example, the second portion may be fixed relative to the first portion, while the first portion may be rotatable relative to the second portion. In such examples, the first portion may be considered to be a rotor and the second portion may be considered to be a stator or vice versa.

The first and second portions may be positioned such that a clearance gap exists between the first and second portions. Such a clearance gap may permit the first and second portions to move relative to one another, without contact occurring between the first and second portions. The clearance gap may be variable between the first and second portion. The clearance gap may have a minimum dimension of 1 mm, or approximately 1 mm. Having a clearance gap of such a dimension may assist the fluid heater to provide substantial amounts of heat, for example by increasing instances of cavitation in the heat transfer fluid.

The surface features may be periodically spaced, such as evenly spaced, across and/or along the first and/or second portions (e.g. the internal and/or external surfaces of the first and/or second portions).

The chamber surface features of the first portion may be aligned with the internal surface features of the second portion. The chamber surface features of the first portion may be axially aligned, or at least partially axially aligned, with the internal surface features of the second portion (e.g. the chamber surface features may at least partially share the same axial location as the internal surface features). Such alignment of the chamber surface features and the internal surface features may assist to permit the fluid heater to provide substantial thermal energy to the heat transfer fluid, for example by facilitating cavitation in the heat transfer fluid when the heating assembly is in use.

In some examples, the first portion may comprise an elongate member. The first portion may comprise a hollow elongate member. The chamber surface features thereof may comprise elongate protrusions extending along the elongate member.

The second portion may comprise an elongate member. The second portion may comprise a hollow elongate member. The internal surface features of the second portion may extend along the hollow elongate member, on the internal surface thereof. The external surface features of the second portion may extend along the hollow elongate member, on the external surface thereof. Such surface features may be evenly distributed around the internal surface thereof. Such surface features may be evenly distributed around the external heating surface thereof. The first and second portions may be concentrically assembled together to provide the fluid heating assembly.

In some examples, the internal surface features of the second portion may be considered to be configured as interstices or grooves, such as V-shaped interstices. The internal surface features of the first portion may be considered to be arranged as fins, vanes, or the like.

In some cases, the internal surface features (e.g. grooves) of the second portion and the chamber surface features (e.g. protrusions) of the first portion may be arranged such that every second feature of the first portion faces an opposite feature of the second potion, and the intermediate features of the first portion face an opposite vertex between every second feature of the second portion.

Where there is an odd number of chamber surface features of the first portion, there may be an even number of internal surface features of the second portion, and vice versa. Having an odd/even relationship of the internal and chamber surface features of the first and second portion may assist to prevent large vibrations of the first and second portions of the heating assembly.

In some examples, in use, the surface features may cooperate to define repetitively transient flow restrictions in the flow path upon relative movement between the first and second portions.

The fluid heating assembly may be configured such that upon relative movement between the first and second portions the heating chamber repetitively varies between a cross-section with minimum fluid flow resistance and a cross-section with maximum fluid flow resistance.

The fluid heating assembly may be elongate. The fluid heating assembly may be cylindrical. The fluid heater, and indeed the fluid heating assembly, may be modular. In some examples the first and/or second portions, for example, may be formed by different or common modular components.

The heating chamber may be or comprise a sealed volume. As such, there may be no flow of heat transfer fluid to/from the heating chamber. The heating chamber may define or comprise an expansion mechanism. The expansion mechanism may be in the form of a piston and cylinder in fluid communication with the heating chamber. The expansion mechanism may permit a degree of expansion (e.g. thermal expansion) of the heat transfer fluid in the heating chamber by permitting flow of the heat transfer fluid into and out of the expansion mechanism. As such, the expansion mechanism may assist to stabilise the fluid pressure inside the heating chamber.

Having a sealed volume may mean that the heat transfer fluid is able to be kept cleaner than if there was exchange of the heat transfer fluid during operation of the fluid heating assembly. As such, having a sealed volume may extend the lifespan of the apparatus. Further, having a sealed volume may enable the clearance of the first portion and the second portion to be reduced, as there may be no requirement for a volume to be present to define a flowpath therethrough, thereby enabling the fluid heating assembly to heat the heat transfer fluid more quickly.

The sealed volume may be sealed by means of a sealing arrangement. The sealing arrangement may comprise a static and/or a dynamic seal. The sealing arrangement may comprise a mechanical seal.

The expansion mechanism may function to protect the sealing arrangement by reducing the differential pressure acting across the sealing arrangement. The sealing arrangement may be or comprise a corrosion resistant seal or corrosion resistant seals. Such a corrosion resistant seal may be made from a corrosion resistant material, or may comprise a corrosion resistant coating, for example.

The downhole mechanical fluid heater may comprise a fluid inlet for passing fluid to the heating chamber (e.g. at least one fluid inlet, such as two fluid inlets). The fluid inlet may be used to replace the heat transfer fluid after a period of time of operation of the assembly. Additionally or alternatively, the fluid inlet may be used to flush the heating chamber, for example flush the heating chamber with a cleaning fluid (e.g. a scale inhibitor), thereby assisting to keep the operation of the assembly efficient, and permit free relative movement between the first portion and the second portion. In such a configuration, then fluid inlet may also be considered to be a fluid outlet.

The fluid inlet (e.g. at least one of the at least one fluid inlets) may be configured to transfer momentum to the fluid entering the downhole mechanical fluid heater, in use. For example, the fluid inlet may comprise a propeller to promote fluid flow through the fluid heating assembly. The propeller may be mounted on a common drive shaft with the first portion. The propeller may be considered to be an injection propeller. The propeller, or other such device at the inlet, may be configured to pressurise fluid in the fluid heating assembly.

The fluid inlet may be releasably attachable to the fluid heating assembly (e.g. using a threaded connection).

The downhole fluid heater may comprise a fluid outlet for passing fluid from the heating chamber (e.g. to a downhole location). The fluid outlet may comprise at least one nozzle. The fluid outlet (e.g. nozzle) may be configured to inject fluid from the fluid heater into a tubular, or the like, or other downhole well infrastructure. The fluid outlet may be configured to permit fluid flow, from the heating chamber, in only one direction. The fluid outlet may be releasably attachable to the fluid heating assembly (e.g. using a threaded connection).

The fluid heater may comprise an external heat transfer surface. Heat may be transferred to a fluid passing adjacent the heat transfer surface from that surface. The external heat transfer surface may be located on the second portion. The external heat transfer surface may be the external surface of the second portion. The external heat transfer surface may be defined by, or located on, an external component on the external surface of the second portion (e.g. affixed to the external surface of the second portion). The external heat transfer surface may comprise surface features, for example as described in relation to the external surface of the second portion. The external heat transfer surface may be configurable to be in thermal communication with a fluid to be heated. The fluid heater may be configurable to transfer thermal energy via the internal surface features of the second portion to the external heat transfer surface of the fluid heater to thereby increase the thermal energy of a fluid to be heated.

The downhole fluid heater may comprise a housing, such as an outer housing. The housing may circumscribe the fluid heating assembly.

The downhole fluid heater may comprise or at least partially define a flow path, for example, for communicating fluid, such as product, to surface. The flow path may be considered to be a production flow path. Such a flow path may be generally in the opposite direction to flow in the heating chamber of the fluid heating assembly.

At least a part of the flow path may be defined by the outer surface of the second portion of the fluid heating assembly. The flow path, e.g. production and/or injection flow path, may be provided, or otherwise defined between a tubular in which the fluid heater is located and the outer surface of the second portion of the fluid heating assembly. The flow path may be provided, or otherwise defined, between a housing of the fluid heater and the fluid heating assembly. The fluid heating assembly may be configured such that heat generated within the fluid heating assembly is transferable to fluid in the flow path. The arrangement may be considered to be a heat exchanger.

The flow path may comprise a flow path inlet. Where the heating chamber comprises a heating chamber outlet, the flow path inlet may be provided in proximity to the heating chamber outlet. The flow path inlet may be co-located with the heating chamber outlet.

The flow path inlet may be configured to mitigate the likelihood of particles entering the flow path. Such particles may be entrained in the fluid passing into the flow path inlet. In some cases, the flow path inlet may comprise a retaining element, such as a grid, mesh or filter, configured to mitigate particles entering the flow path. Such particles may include sand (e.g. sand being liberated and produced downhole).

The flow path inlet may be configured to avoid particles above a certain size entering the flow path. For example, the flow path inlet may comprise a particle size reducer, such as a grinder (e.g. sand grinder), configured to reduce the size of the particles entering the flow path. The particle size reducer may comprise a rotatable element mounted within a reducer housing. In some examples, the rotatable element may be eccentrically mounted within the reducer housing, such that the rotatable element rotatably contacts, or otherwise impinges, on an inner surface of the reducer housing.

In some examples, the rotatable element may be driven via a drive shaft. The drive shaft may be common to the particle size reducer and the fluid heating assembly. In some examples, a drive shaft driving mechanical movement of the first portion (e.g. the rotor) may additionally drive rotation movement of the particle size reducer. The drive shaft may be mounted upon bearings in the fluid heating assembly. The bearings may be configured to function under high rotational speeds of the shaft, and high temperature.

The flow path may comprise a flow path outlet. Where the heating chamber comprises a heating chamber inlet, the flow path outlet may be provided in proximity to the heating chamber inlet. The flow path outlet may be co-located with the heating chamber inlet.

The fluid heater may be configured such that heat is transferred to the fluid in the flow path from the heating chamber. Heat may be transferred through the material of the second portion. The fluid heater may be configured such that fluid flowing within the flow path is counter current to fluid in the heating chamber (e.g. such that fluid flowing within the flow path flows in the opposite direction to that in the heating chamber), such that heat is transferred to the fluid in the flow path from the heating chamber.

The downhole fluid heater may comprise a plurality of inlet ports provided at the various inlets and outlets of the heating assembly heating chamber and flow path, e.g. production flow path.

The downhole fluid heater may be powered by one or more of an electric motor, a hydraulic motor, a pneumatic motor, a rotating shaft transmitting motion from another power source. More than one source of mechanical power may be used to power the fluid heater as alternative or complementary power sources.

The downhole fluid heater may be adapted to be directly or indirectly coupled to a fluid driving or propelling unit, such as an electrical submersible pump (ESP).

The downhole fluid heater may comprise a coupling arrangement. The coupling arrangement may permit coupling of the downhole fluid heater with another downhole fluid heater (e.g. a similar or identical downhole fluid heater).

The downhole fluid heater may be configured to transform liquid to vapour or gas. In some examples, the heating chamber of the heating assembly may increase in cross-section along the fluid heating assembly in order to accommodate liquid expansion and/or vapour/gas generation.

In some examples, the downhole fluid heater may be configured to admit liquid fluids and/or to expel or inject gas, such as steam. In some examples, the downhole fluid heater may be configured to admit liquid fluids and heat so as to reduce the viscosity of the fluids (e.g. within a production flow path).

The downhole fluid heater may be configured to measure the power input transmitted to the fluid heater. The fluid heater may be configured to measure the speed of the movable portions. The downhole fluid heater may be configured to measure fluid flow through the fluid heater.

The downhole fluid heater may be configured to adjust the energy input, for example mechanical energy input. In some examples, the fluid heater may comprise a processor unit configured to send a command to adjust the mechanical energy input in response to one or more measured parameters at the fluid heater, in use (e.g. at the heating chamber outlet).

The downhole fluid heater may be configured to receive one or more parameters that correspond to desired characteristics of fluid at the heating chamber fluid outlet, in use, such as, for example, temperature and/or pressure.

The downhole fluid heater may be configured to maintain, within certain limits, one or more characteristics of the fluid corresponding to the one or more received parameters, in use. In some examples, the fluid heater may comprise a control processor that receives temperature and/or pressure parameters from a user. In other examples, the control processor may be located at surface.

Temperature and/or pressure parameters may be compared by the control processor with temperature and pressure measured at or in the fluid heater by the temperature and pressure sensors. The magnitude of any differences may then be used by the control processor to calculate and send a command to adjust the mechanical power input. This may include increasing torque and/or relative movement of the first/second portions (e.g. revolutions per minute of the first and/or second portion).

The downhole fluid heater may comprise a thermal insulation barrier, such as an external polymeric coating of, for example EPDM rubber.

Some examples of the downhole fluid heater may be made at least in part of a corrosion resistant alloy. The corrosion resistant alloy may be in the form of, or may comprise, nickel plating (e.g. a nickel plated material), and/or may comprise zinc plating. In particular, an outer housing of the downhole fluid heater may be made of corrosion resistant material. Such a corrosion resistant material may be Inconel alloy, or may be a zinc plated metal or metal alloy. Some examples, the downhole fluid heater may be made at least in part of aluminium or aluminium alloy. In one example, the downhole fluid heater may be or comprise a zinc plated aluminium. The material from which the downhole fluid heater is made may enable a lightweight downhole fluid heater to be manufactured, while also permitting the downhole fluid heater to be made from a corrosion resistant material.

In some examples, one or more parts of the downhole fluid heater may be made of a technical ceramic.

The downhole fluid heater may comprise positioning, centralising and/or anchoring elements for use downhole.

In some examples there is described a fluid heater for use in an oil and gas conduit, such as a production and/or transportation pipeline. The heater may have any of the above described features.

In some examples, there is described a fluid heater, such as a downhole fluid heater, comprising:

a fluid heating assembly comprising a heating chamber for receiving a fluid, and wherein the fluid heating assembly is configured to agitate a heat transfer fluid (e.g. mechanically agitate fluid) in the heating chamber so as impart thermal energy and heat the heat transfer fluid.

In some examples, there is described a fluid heater, such as a downhole fluid heater, comprising:

a fluid heating assembly comprising a first portion and a second portion arranged such that the first portion and the second portion define a heating chamber therebetween, at least one of the first portion and second portions comprising surface features provided in the flow path;

the fluid heating assembly being configured such that the first and second portions are movable relative to one another so as to cause relative movement of the surface features in the heating chamber, and so being configured to agitate fluid in the flow path and impart thermal energy and heat that fluid.

In some examples, there is described a method for heating fluid, for example, heating fluid downhole. Such a method may be used for enhanced oil recovery.

The method may comprise providing a fluid heater downhole. Such a fluid heater may comprise a fluid heating assembly. The fluid heating assembly may comprise a heating chamber for receiving a fluid (e.g. a fluid to be heated). The received fluid may be delivered to the heating assembly by a fluid delivery arrangement, for example by a fluid pump (e.g. a fluid pump at a surface of a wellbore, or a downhole fluid pump) or by an arrangement of fluid pumps. The fluid heating assembly may be configured to agitate fluid (e.g. mechanically agitate fluid) in the heating chamber so as impart thermal energy and heat that fluid.

The fluid to be heated may comprise water. The fluid to be headed may comprise a foaming agent.

The fluid heating assembly may have a first portion and a second portion arranged such that the first portion and the second portion define the heating chamber therebetween. In some examples, at least one of the first portion and second portions may comprise surface features provided in the heating chamber.

The method may comprise communicating a fluid to be heated to the heating chamber. Further, the method may comprise producing mechanical relative movement within the heating chamber (e.g. between the first portion and second portion) so as to cause relative movement of surface features in the heating chamber. The method may comprise agitating the fluid in the flow path so as to impart thermal energy and heat to that fluid.

The method may comprise propelling fluid from an inlet along the heating chamber. The method may comprise injecting heating fluid, for example, downhole, from an outlet of the heating chamber.

The method may comprise communicating liquid to the heater, and injecting gas from the heater downhole. The method may comprise communicating fluid to the fluid heater at a particular pressure and/or temperature. That temperature/pressure may be selected such that the fluid remains in a liquid phase until reaching the heater, but leaves the heater in a gas phase. The method may comprise transferring heat from the fluid heater to produced fluid passing the heater to surface.

The method may be for use in enhanced oil recovery.

The method may comprise heating fluid surrounding the heating assembly. The method may comprise heating product, such as oil (e.g. and reducing viscosity).

The method may comprise reconfiguring the downhole fluid heater for use between injection and production modes (e.g. for use in heating an injection fluid and for use in heating a production fluid). The method may comprising using the downhole heater in both injection and production modes. The heater may be used to heat a fluid being injected and/or produced to, for example, 80 to 120° C. The heater may be used to heat a fluid being injected and/or produced from a temperature of, for example, 35 to 40° C. to 80 to 120° C.

In some examples, there is described a method for heating fluid downhole comprising:

providing a fluid heater downhole, the fluid heater comprising a fluid heating assembly; and agitating a heat transfer fluid in the fluid heating assembly so as to impart thermal energy and heat to the heat transfer fluid.

In some examples, there is described a method for heating fluid downhole comprising:

providing a fluid heater downhole, the fluid heater comprising a fluid heating assembly having a first portion and a second portion arranged such that the first portion and the second portion define a heating chamber therebetween, at least one of the first portion and second portions comprising surface features provided in the heating chamber;

providing a fluid to be heated to the heating chamber;

producing mechanical relative movement between the first portion and second portion so as to cause relative movement of the surface features in the heating chamber, and so agitating the fluid in the flow path thus imparting thermal energy and heat to that fluid.

In some examples, there is described a method for heating fluid downhole, comprising:

providing a fluid heater downhole, the fluid heater comprising a fluid heating assembly, the fluid heating assembly comprising a first portion and a second portion, and comprising a heating chamber for receiving a heat transfer fluid, the heating chamber being defined between an internal surface of the first portion and an internal surface of the second portion, the first portion comprising internal surface features on the internal surface thereof, and the second portion comprising internal surface features on the internal surface thereof, the second portion further comprising an external heat transfer surface configurable to be in thermal communication with a heating fluid; and agitating a heat transfer fluid in the heating chamber of the fluid heating assembly so as to impart thermal energy and heat to that heat transfer fluid; and heating the heating fluid with the heating assembly.

The invention includes one or more corresponding aspects, examples or features in isolation or in various combinations whether or not specifically stated (including claimed) in that combination or in isolation. As will be appreciated, features associated with particular recited examples relating to fluid heater, or the like, may be equally appropriate as features relating specifically to methods of operation or use, and vice versa.

It will be appreciated that one or more examples/aspects may be useful improving safety, while efficiently assisting with oil recovery, and being cost effective.

The above summary is intended to be merely exemplary and non-limiting.

BRIEF DESCRIPTION OF THE DRAWINGS

A description is now given, by way of example only, with reference to the accompanying drawings, in which:—

FIGS. 5A and 5B show schematic representations of a downhole fluid heater assembled with other units to perform an Enhanced Oil Recovery operation, or the like.

DETAILED DESCRIPTION OF THE DRAWINGS

The following examples are given with reference specifically to heating fluid downhole, and in particular downhole fluid heating for the purposes of heating injection and/or production fluid (e.g. for using with Enhanced Oil Recovery). However, a skilled reader will appreciate that the following apparatus and methods may be used elsewhere, and for alternative applications, such as within an alternative oil and gas conduit systems where effective heating of fluid may be beneficial.

Figure 1A:
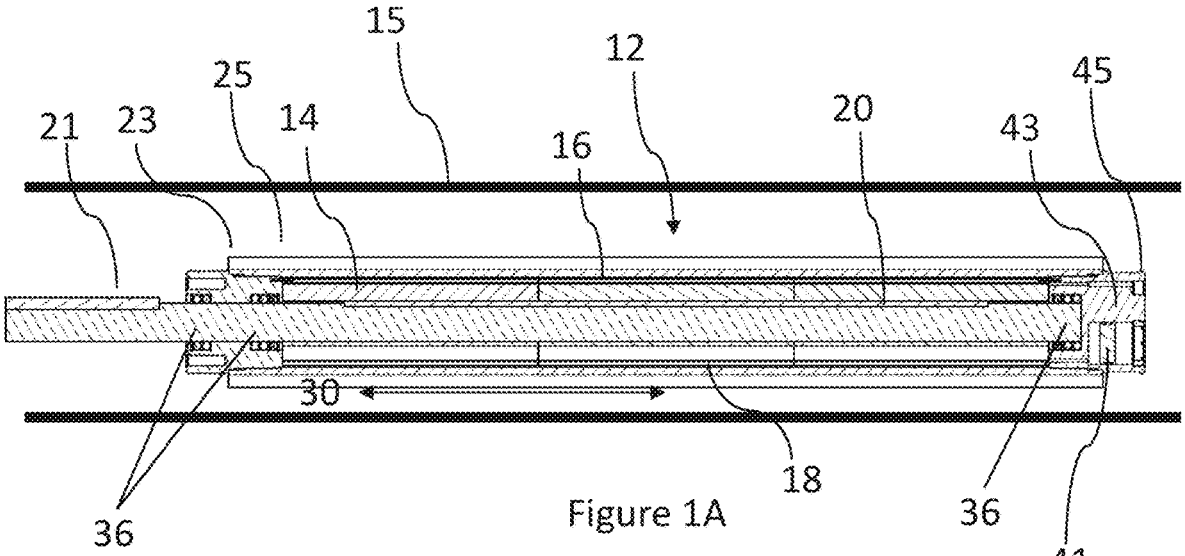
FIG. 1A is a sectional elevation view of a fluid heater according to one example.
Figure 1B:
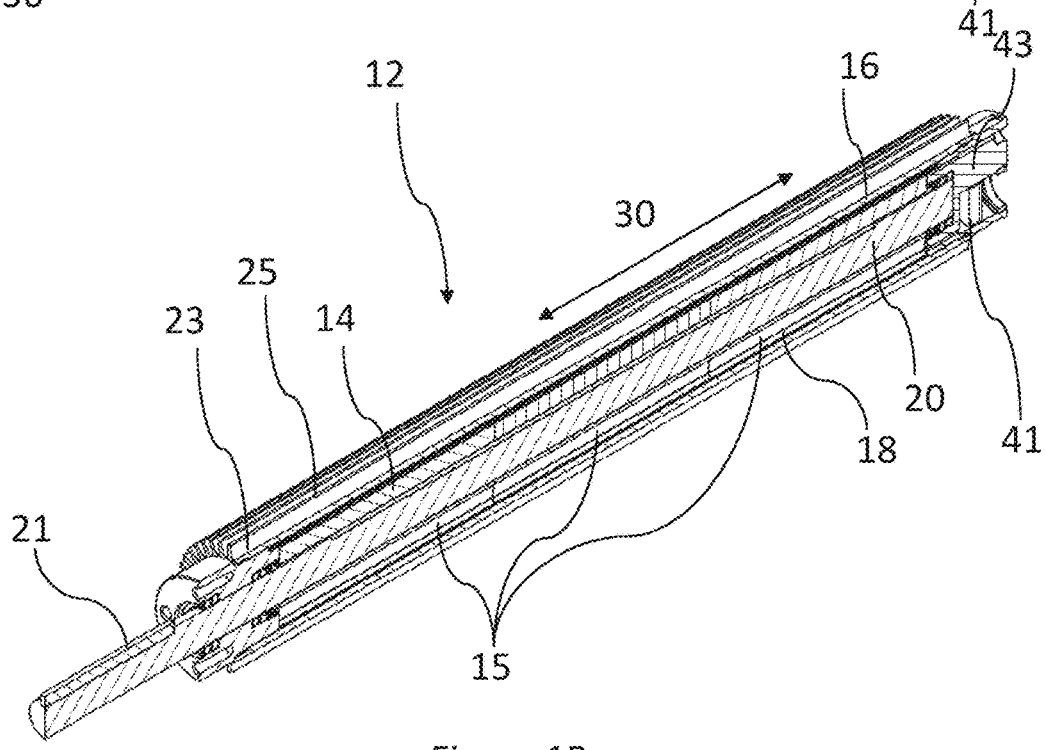
FIG. 1B is a sectional isometric view of the fluid heater of FIG. 1A.

FIGS. 1A and 1B are side and isometric sectional views, respectively, of a fluid heater comprising a fluid heating assembly 12 in the form of a heat exchanger, for use in a downhole fluid heater. In FIG. 1A, the heating assembly 12 is located in a tubular 15. The fluid heating assembly 12 comprises a heating chamber 18 configured to heat fluid. As will be further explained, the fluid heating assembly 12 is configured to agitate fluid in the heating chamber 18 so as to impart thermal energy and heat that fluid.

While such agitation may be effected by a number of mechanisms, by way of an example only, in this case the fluid heating assembly 12 comprises a first portion 14 and a second portion 16 arranged such that they define the heating chamber 18 therebetween. The heating chamber may also be considered to be defined along the downhole fluid heater 10. In this example, both the first portion 14 and second portion 16 comprise surface features (see FIG. 3 for example) on their surfaces and, when assembled, the surface features lie in the heating chamber 18.

As will be further explained, the fluid heating assembly 12 is configured such that the first portion 14 is movable relative to the second portion 16 so as to cause relative movement of the surface features in the heating chamber 18. In doing so, the features are configured, in use, to agitate fluid in the heating chamber 18 and impart thermal energy and heat that fluid. In this example, the first portion 14 is essentially configured as a rotor, which is mounted on a shaft 20 that receives mechanical power, while the second portion 16 is configured as a stator.

A portion of the shaft 20 extends axially from the heating assembly 12, and comprises a key 21, while in this example the shaft is held in place by bearings. The key 21 may enable the shaft to be coupled to a rotation mechanism for driving the shaft 20 and thereby turning the first portion 14. The rotation mechanism may be, for example, a motor, and the bearings may be configured to function under high rotational speeds of the shaft 20, and the associated high temperatures. The intended rotational speeds may be 50 Hz, 60 Hz or higher. Although not shown in FIG. 1A, the rotation mechanism may be positioned uphole of the fluid heater.

The heating chamber 18 is sealed by way of a sealing arrangement 36 in the example of FIGS. 1A and 1B, such that flow of a heat transfer fluid into an out of the heating chamber 18 is not permitted during operation of the fluid heating assembly 12. In this example, the sealing arrangement 36 comprises a series of mechanical seals, although the skilled person will appreciate that other sealing arrangements may be possible. Any appropriate fluid may be used as a heat transfer fluid. For example, the heat transfer fluid may be an oil, such as a viscous gear oil. The fluid heating assembly 12 comprises an end plug 43 which defines an expansion mechanism 41, which is in the form of a piston and cylinder, in this example. The expansion mechanism 41 forms a part of the heating chamber 18, and the volume of the expansion mechanism 41 is able to be adjusted (e.g. expanded and/or contracted) to permit expansion and/or contraction of the heat transfer fluid in the heating chamber 18. As such, the expansion mechanism 41 assists in stabilising the pressure of the heat transfer fluid in the heating chamber 18. The piston of the expansion mechanism 41 may be exposed to a pressure source external to the fluid heating assembly 12, such that positioning of the piston in the expansion mechanism 41 will be influenced by both the pressure of the heat transfer fluid in the heating chamber 18 and a pressure source external to the fluid heating assembly 12 (e.g. the ambient pressure surrounding the fluid heating assembly 12). The piston expansion mechanism may assist to prolong the life of the sealing arrangement 36 by reducing the differential pressure acting across the sealing arrangement. Further, the sealing arrangement 36 (e.g. the mechanical seals of the sealing arrangement) may be corrosion resistant. For example, the sealing arrangement may be or comprise a corrosion resistant material, or may be coated in a corrosion resistant material. The end plug 43 also defines a fluid port 45, which may be used to fill and/or empty heat transfer fluid to/from the heating chamber 18. In some examples, the fluid port 45 may also be used to flush the heating chamber 18 with cleaning fluid such as a scale inhibitor. As such, the fluid port may assist in cleaning operations of the heating chamber 18 of the fluid heating assembly.

In this example, the second portion 16 comprises an external surface 23 which comprises surface features 25. Here, the surface features 25 are in the form of fins which extend axially along the external surface 23 of the second portion 16. In use, the fins may assist to more effectively transfer heat from the heating chamber 18 to a fluid flowing in a flow path 30 in which, or adjacent which, the heating assembly may be located. It should be noted that, while the flow path 30 has been given a direction as shown in FIG. 1A, fluid flow may not be restricted to flow in this direction, and flow in an opposite direction may be equally possible.

Further, in this example, the fluid heating assembly 12 is comprised of a plurality of discrete and connectable modules 15. As such, the fluid heater assembly 12 may be constructed in module sections, which can be connected to each other and therefore the downhole fluid heater 10 can be easily upgraded or downgraded to have more or less capacity and power, according to operational requirements.

As shown in the example of FIG. 1A, the heating assembly 12 may be located in a casing or tubular (e.g. a wellbore casing or tubular), and the flowpath 30 may be defined between the tubular and the external surface 23 of the heating assembly 12. Further, in some examples, the heating assembly 12 may comprise an external shroud (not shown in FIGS. 1A and 1B), which may take the form of an external housing. Further, the heating assembly 12 comprising a shroud may be connected to a flowline. For example, the shroud may be connected to, or secured against a flowline, and fluid in the flowline may pass between the external surface 23 of the heating assembly 12 and the shroud. The external shroud may assist to direct flow of a fluid to be heated past the external surface 23 of the heating assembly 12, for example. The shroud may additionally function to protect the external surface 23 from damage, for example from being run downhole.

While the heating chamber 18, as shown in FIGS. 1A and 1B is sealed, such that fluid flow of heat transfer fluid into and out of the heating chamber 18 is not permitted, in some examples the heating chamber may permit fluid flow therethrough. For example, and as will be subsequently described, the heating chamber 18 may comprise a fluid inlet and a fluid outlet to enable flow of the heat transfer fluid to and from the heating chamber 18.

Although not shown in FIG. 1A, a fluid to be heated may be delivered to the fluid heater 12 by means of a fluid delivery mechanism, which may be a pump, or an arrangement of pumps. The fluid delivery mechanism may be located at a surface of the wellbore, and/or may be located downhole (e.g. uphole or downhole relative to the fluid heater). The fluid delivery mechanism may assist to deliver production and/or injection fluids to be heated to the fluid heater 12, for example via flow path 30.

Figure 2A:
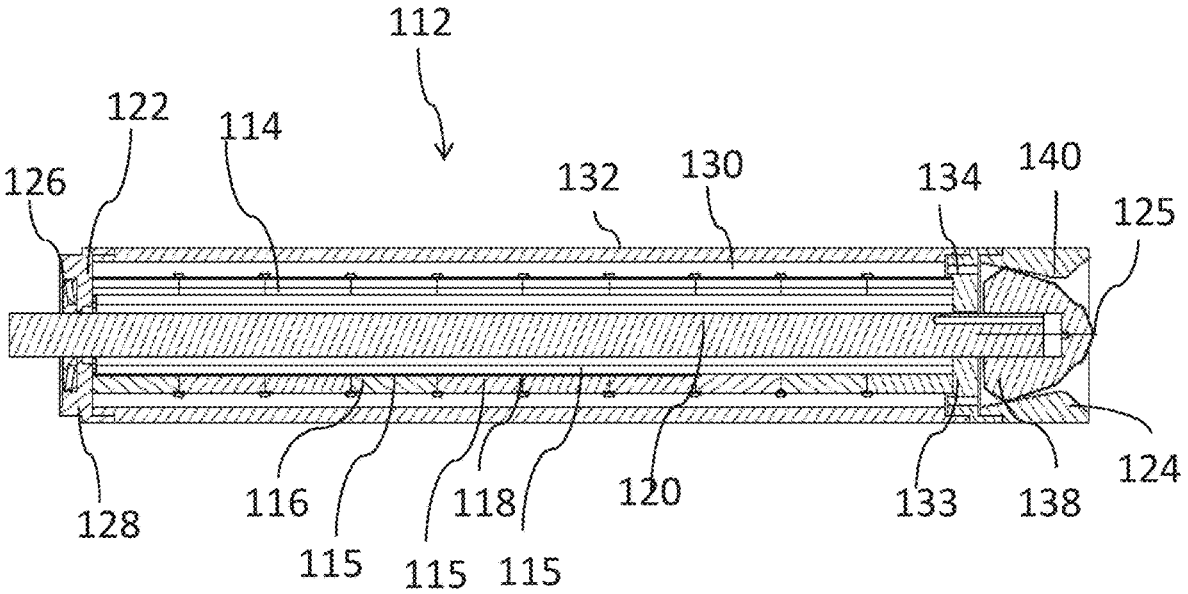
FIG. 2A is an sectional elevation view of a fluid heater according to a further example.
Figure 2B:
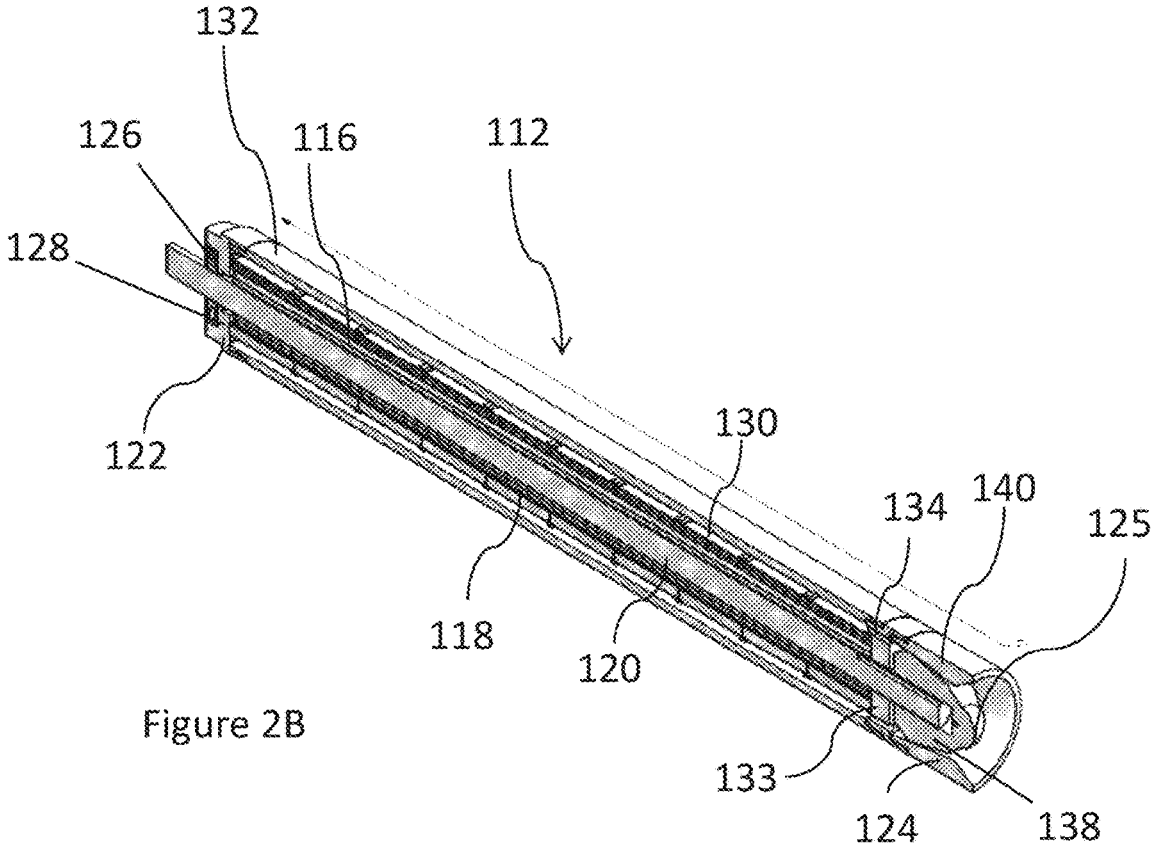
FIG. 2B is a sectional isometric view of the fluid heater of FIG. 2A.

FIGS. 2A and 2B are perspective and side sectional views, respectively, of a downhole fluid heater comprising fluid heating assembly, generally indicated by reference numeral 112. Many of the components shown in FIGS. 2A and 2B are similar to those shown in FIG. 1A and FIG. 1B. As such, alike reference numerals have been used, incremented by 100.

The fluid heating assembly 112 comprises a heating chamber 118 configured to heat fluid. In a similar manner to the example described in FIGS. 1A and 1B, the fluid heating assembly 112 is configured to agitate fluid in the heating chamber 118 so as to impart thermal energy and heat the fluid.

The downhole fluid heater 112 in this example comprises a housing 132 which connects a fluid inlet component 122 to the heating assembly, i.e. to the heating chamber 118, as well as a fluid outlet component 124. The fluid inlet component 122 may comprise or define a fluid inlet, while the fluid outlet component 124 may comprise a fluid outlet to the heating chamber 118. Both the inlet component 122 and outlet component 124 are threaded to each end of the housing 132, respectively. As such, the fluid heater 110 may be reconfigurable by attaching/detaching each of the inlet and outlet components 122, 124, for example, depending on application, as will be explained.

The inlet 122 comprises a propeller 126 located in the fluid inlet component 122 to feed fluid into the fluid heating assembly 112, and heating chamber 118. Here, the propeller is mounted on the shaft 120, and further optionally comprises a perforated plate 128, defined by the fluid inlet component 122. The fluid outlet 124 comprises a nozzle 125 from which fluid (e.g. gas) can expelled from the flow path 118 downhole (e.g. into a downhole tubular, open hole, or the like)—see FIG. 4, which shows an end elevation of the fluid outlet 124.

Additionally, in this example, the fluid heater 110 comprises a flow path 130, which may in some examples be considered to be a production flow path 130, i.e. a flow path for permitting communication of product to surface. The flow path 130 is defined between the fluid heating assembly 112 and a housing 132. The flow path 130 surrounds, or otherwise circumscribes, the heating chamber 118 of the heating assembly 112, such that heat may be transferred to or from the heating assembly 112, in use, to or from the flow path 130, for example, depending on the relative temperatures between the fluids in each of the flow path 130 and heating chamber 118.

The flow path 130 may be considered to comprise a flow path inlet. In the example shown, the flow path inlet is provided in proximity to the heating assembly outlet 124 (e.g. an outlet of the heating chamber 118), and may otherwise be considered to be co-located with the heating assembly outlet 124 (in other examples that need not be the case). The flow path inlet comprises a plate 133 with multiple ports 134 that allow fluid access to the flow path 130. In contrast to the example shown in FIGS. 1A and 1B, the fluid heater 110 defines a contra-flow arrangement, whereby a flow path is defined through the heating chamber 118 and may be used to flow a fluid (e.g. a heat transfer fluid) in one direction, and a separate production flow path 130 is defined between the heating assembly 112 and the housing 132 which may be used to flow a fluid (e.g. a production fluid) in a second opposite direction. Alternatively, the flow path in the heating chamber 118 and the production flow path 130 may be used to flow a fluid, or two separate fluids, in the same direction (for example where the fluid heater 110 is used to heat an injection fluid, rather than a production fluid). Steps may be taken to ensure that the heat transfer fluid in the heating chamber 118 and the fluid in the production flow path 130 are isolated and do not mix in the fluid heater 110, or prior to entry into the fluid heater 110. For example, the heat transfer fluid may be delivered to the fluid heater 110 in a conduit from a surface location, so as to isolate the heat transfer fluid from any production fluid.

In this example, the flow path inlet is further configured to mitigate the likelihood of particles entering the flow path 130. Such particles may be entrained in the fluid passing into the flow path inlet. Such particles may include sand (e.g. sand being liberated and produced downhole).

In this example, the flow path inlet comprises a particle size reducer, such as a grinder (e.g. sand grinder), configured to reduce the size of the particles entering the flow path 130. The reducer comprises a grinding element 138 or sand cone mounted on the shaft 120 and a housing 140 that surrounds the sand cone 138. The sand cone 138 is shaped so that its outermost surface rotates eccentrically with respect of the housing 140 inner wall, in use. In that manner, upon rotation of the shaft 120, the sand cone walls approach and retract from the housing walls periodically, thereby crushing any particles trapped or passing therebetween. The shaft 120 is held in place by bearings (not shown) mounted in the inlet plate 128 and the outlet plate 133. As in the previous example, the bearings may be configured to function under high rotational speeds of the shaft 120 and high temperatures.

In this example, the housing 132 of the fluid heater 110 may be made of corrosion resistant alloy (e.g. a plated or coated material such as zinc plated aluminium or a zinc plated aluminium alloy), or the like. In this way, the downhole fluid heater 110 may be more durable in downhole conditions.

Further, the first portion 114 (e.g. the rotor) and the second portion 116 (e.g. the stator) may be fabricated from aluminium alloy, or the like. In this way, although aluminium may be less resistant to corrosion, and have less thermal isolation properties, the fabrication of the complex geometry of the first/second portion need not be excessively costly.

It will however be appreciated that other construction materials may be used, and may be application dependent. Likewise, other arrangements of the rotor and stator may be possible, for example, the rotor may be external to the stator. Another arrangement may be when both the first portion and second portion are movable and therefore there are two rotors which rotate in opposite directions. Such a configuration may be possible from a common drive shaft (e.g. by using a gearing mechanism between first and second portion). Having both first and second portions counter rotate may increase any fluid agitation, e.g. by increasing relative revolutions per minute.

In some examples, the fluid heating assembly 112 may be coated with an insulating layer, for example, where heat loss towards the environment may be considered to be excessive. Suitable materials for an insulating layer may be EPDM rubber, for example.

As with the previous example, and although not shown in FIGS. 2A and 2B, fluid to be heated may be delivered to the fluid heater 110 by a fluid delivery arrangement, which may be a fluid pump, or an arrangement of fluid pumps.

Figure 3:
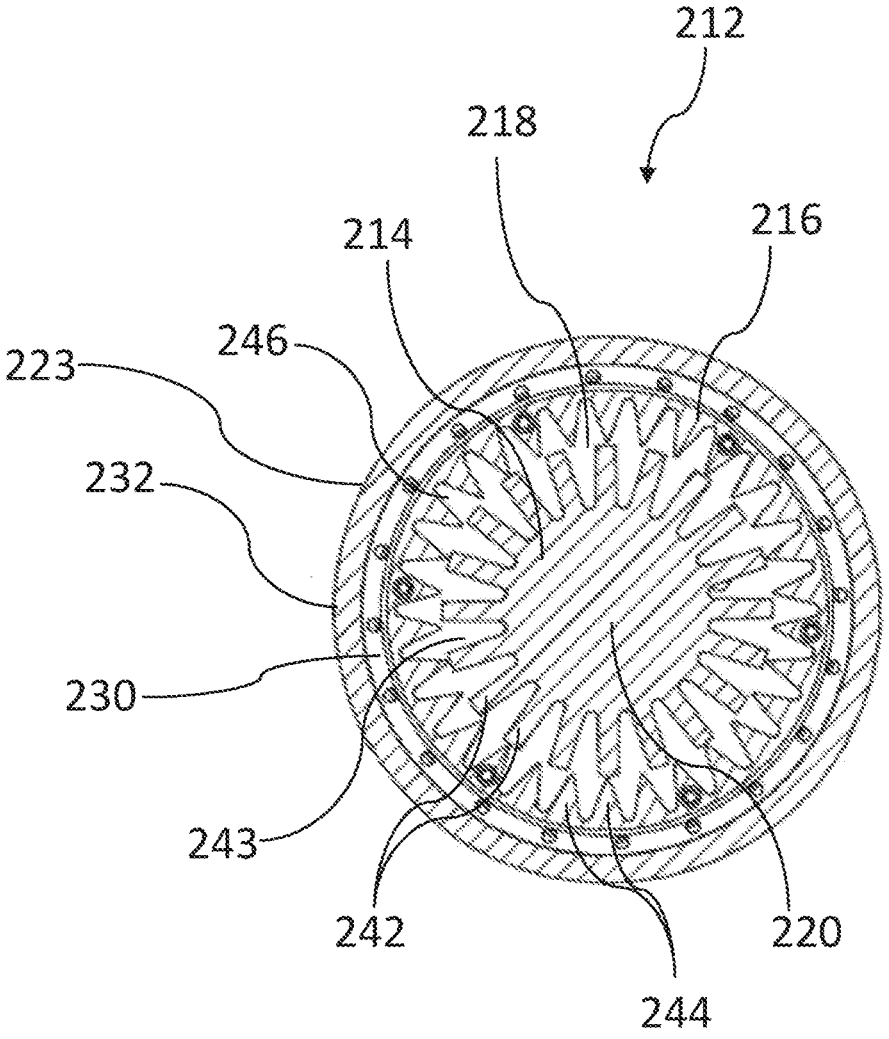
FIG. 3 is a sectional elevation view of a fluid heater.

Referring now to FIG. 3, a description of an example of the internal parts of a downhole fluid heater 10 will be given. Many of the components shown in FIG. 3 are similar to those shown in FIGS. 1A and 1B. As such, alike reference numerals have been used, incremented by 200.

FIG. 3 shows a front sectional view of a downhole fluid heating assembly 212. In this example, the downhole fluid heating assembly 212 is shown in a housing 232, which may enable parameters associated with the fluid heating assembly 212 to be assessed. The fluid heating assembly 212 has a heating chamber 218 defined between the second portion or stator 216 and the first portion or rotor 214, the shaft 220, together with the housing 232 having the flow path 230, e.g. production flow path, between the housing 232 and the second portion 216. Here, it can be seen that all the elements of the fluid heating assembly 212 are arranged concentrically.

In this example, the first portion or rotor 214 comprises a plurality of chamber surface features 242, which in this example are evenly arranged around the rotor 214 on its external surface. The chamber surface features 242 are elongate and extend along the fluid heating assembly 212 (e.g. axially along). The chamber surface features 242 may be considered to protrusions from the rotor 214. In this case, the protrusions take the shape of elongate fins, or the like, having a rectangular or planar end region or tip. In some examples, the chamber surface features 242 may be considered to define a set of V-shaped interstices 243 disposed in the heating chamber 218. In this example, the V-shaped interstices 243 are defined by the chamber surface features 242. In this case, each of the chamber surface features 242 joins to each adjacent chamber surface feature 242 at a filleted section, which also defines a part of the V-shaped interstices 243. The chamber surface features 242 and the V-shaped interstices 243 are evenly disposed.

In addition to the chamber surface features 242 shown on the rotor 214, FIG. 3 shows the stator 216 further comprising a plurality of internal surface features 244. In this example, these may be considered to be arranged on the stator inner surface (e.g. evenly on the inner surface of the stator). Again, the internal surface features 244 are elongate and extend along the fluid heating assembly 212. The internal surface features 244 again may be considered to be protrusions, and in this case take the shape of an elongate triangular prism. The internal surface features 244 may be considered to define V-shaped interstices 246 therebetween. Again, each of the internal surface features 244 joins to each adjacent internal surface feature 244 at a filleted section, also defining part of the V-shaped interstices 246. A clearance or spacing is provided between the surface features of the rotor/stator such that relative movement can be effected. The clearance provided between the first portion 214 and the second portion 216 may be, for example, 1 mm.

In this example, the fluid heating assembly 212 has an external surface 223 that is smooth, and does not comprise any external surface features. As such, the fluid heating assembly 212 may be able to fit into a more compact housing 232 than would otherwise be the case. This may be desirable in some applications.

In some examples one of the first and second portions may be movable and the other may be stationary, whereas in other examples both the first and second portions may be movable. In some examples the first and second portions may be movable in opposite directions whereas in other examples they may be movable in the same direction.

It will be appreciated that the gap or spacing between the surface features 242, 244 and the interstices 243, 246 shown in FIG. 3 may be variable, and as such examples may be possible having a different spacing of surface features 244 and/or interstices as compared to that shown in FIG. 3. It may be possible to have examples where the spacing of surface features 244 and/or interstices 246 is closer or further apart as compared to that shown in FIG. 3. Such a variation in spacing may be selected based on the viscosity of the fluids being heated.

It will be appreciated that in a single fluid heating assembly 212 different types of modules can be combined (e.g. modules 15 as shown in FIGS. 1A and 1B). The different type of modules may have differing variation of spacing between surface features 244 and grooves 246, for example. In one example, a fluid heating assembly 212 may comprise modules with a wider gap closer to the fluid inlet and modules with a narrower gap closer to the fluid outlet or vice versa.

In this example, it will be appreciated that every second surface feature 242 of the rotor 214 faces an opposite surface feature 244 of the stator 216 whereas the remaining surface features 242 face an opposite groove 246 of the stator 216. This particular arrangement of surface formations may provide for a smoother rotation of the rotor when the fluid heater is in use.

Although not shown in this example, one example of the apparatus may comprise an even number of interstices 246 and an odd number of surface features 242, or vice versa. Such an arrangement may assist to minimise vibrations in the rotor 214 and/or the stator 216 when the heating assembly 212 is in use. It will be appreciated that, although a fixed number of interstices 246 and surface features 242 is required to be shown for the purposes of this example, the skilled person would understand that the exact number could be varied in line with the present disclosure.

Although in the example of FIG. 3, a single shape of surface features 242, 244 is shown on each of the rotor 214 and stator 216, the surface features 242, 244 need not be constrained to a single geometry or type. In fact, surface features may include protrusions such as spikes, teeth, fins, undulations, knobs, baffles, etc.; depressions such as dimples, grooves, holes, slots, etc.; textured surfaces such as knurled surfaces, sand coated surfaces, patterned surfaces etc.; and/or combinations thereof.

The tips or the base of the interstices and/or protrusions do not need to be constrained to a single type and may end in a pointed geometry, flat surface, curved surface, serrated surface, profiled surface etc.

Longitudinal surface features such as fins and grooves need not be limited to being straight, and other geometries may be conveniently used, such as curved, undulated or helical. For example, helical longitudinal features may help the fluid travel in the longitudinal direction along the flow path.

Likewise the direction of the longitudinal features need not be limited to being parallel to the fluid path and they can be perpendicular or oblique to the fluid path direction.

It will be understood that the main flow path cross-sections do not necessarily have to be regular nor uniform along the apparatus and that the main flow path cross-section may vary, e.g. in surface and/or shape, along the length of the apparatus, for example to accommodate changes in fluid volume and/or viscosity or to provide a sort of impelling action when the apparatus is in motion.

Figure 4:
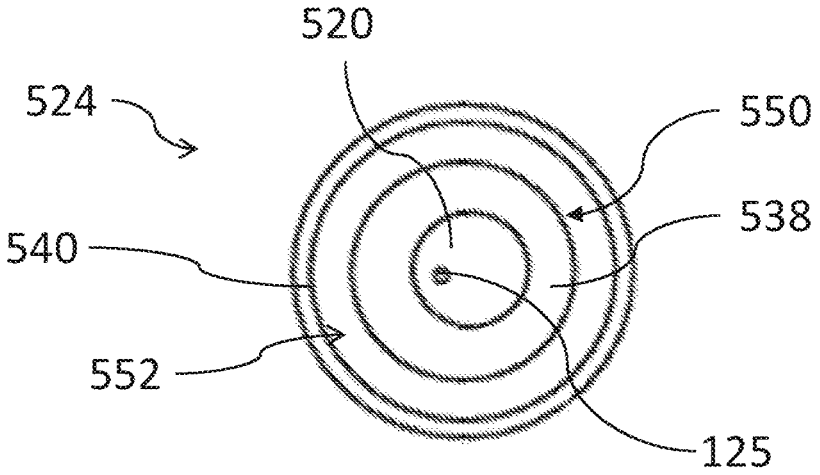
FIG. 4 is an end view of a downhole fluid heater showing in detail a particle size reducer.

FIG. 4 shows a front view of a fluid outlet 524 from the heating chamber 118 of the downhole fluid heating assembly 112, a having an injection nozzle 125 as described in relation to FIGS. 2A and 2B. As mentioned, the outlet of the fluid heating assembly 112 may be co-located with the inlet of a production flow path. As such, here a housing 540 is shown together with a grinding element 538 or sand cone mounted on a shaft 520. The housing 540 surrounds the sand cone 538. The sand cone 538 is shaped so that its outermost surface 550 is eccentrically rotatable with respect of the housing 540 inner wall 552. In that manner, in use, upon rotation of the shaft 520, the sand cone outermost surface 550 will approach to and retract from the housing inner wall 552 periodically, thereby crushing any particles trapped or passing therebetween. While not always needed to be the case, it will be appreciated that in the above examples, a common drive shaft may be used for propeller, rotor as well as sand cone.

In use, the downhole heater may be used in injection mode (e.g. to heat an injection fluid), production mode (e.g. to heat a production fluid), or combination thereof, as will be explained.

Figure 5A:
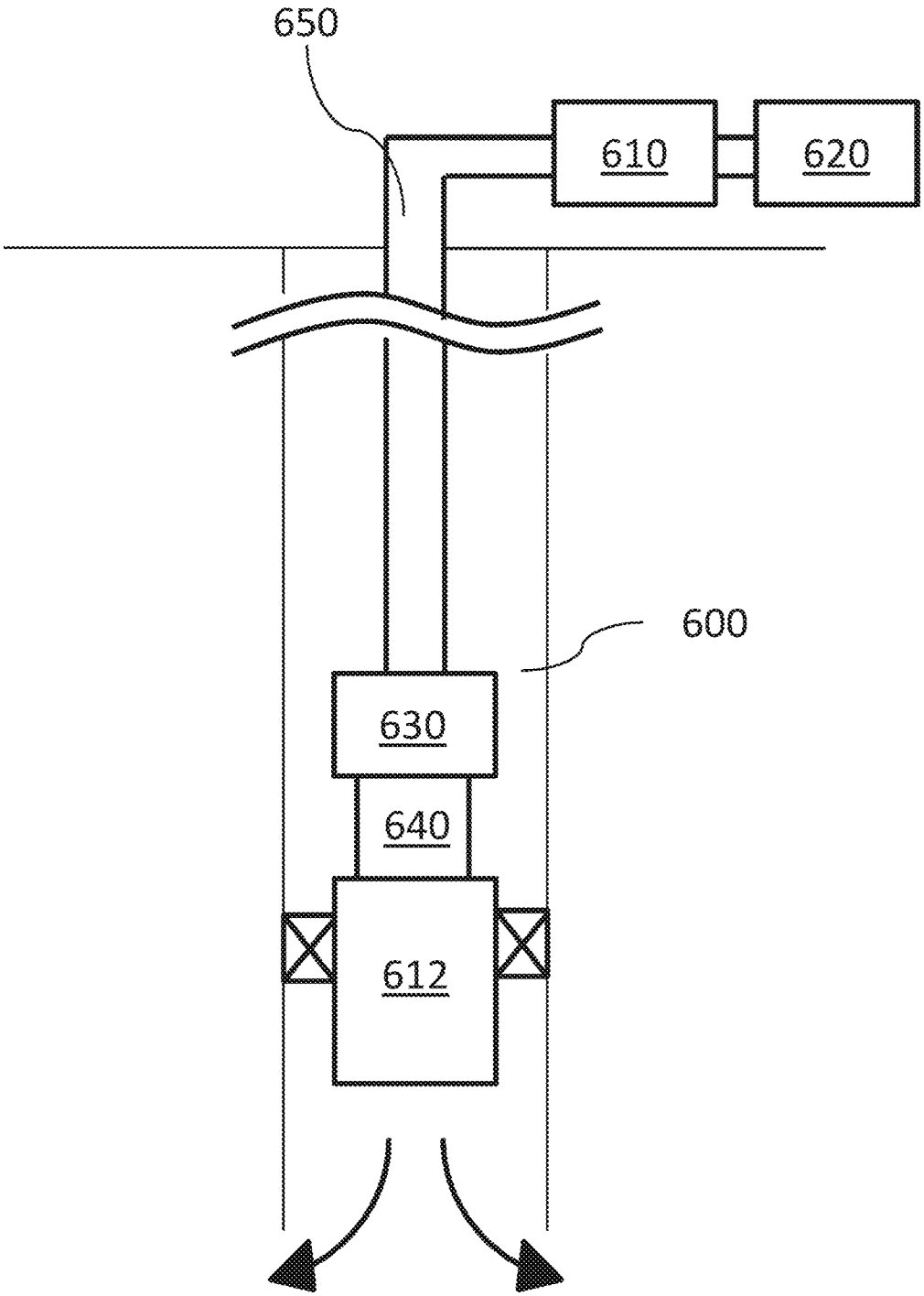

FIG. 5A shows a simplified representation of deploying a fluid heating apparatus 612 downhole in a well 500. Here, the heating apparatus 612 may be considered to be in injection mode in which steam, or the like, is injected into a tubular or otherwise well infrastructure, formation, etc., downhole. Here, the heating apparatus 612 is coupled to a downhole motor 640, which is turn is coupled to a downhole pump 630. The injection conduit 650 for supplying injection fluid to the heating assembly 612 extends between the downhole pump 630 and a surface pump 610, which in turn is fluidly connected to a fluid source 620 (e.g. of water, or the like). It will be appreciated that in other examples only one of the downhole pump and surface pump 610 may be provided.

In any event, fluid from the fluid source can be pumped to the heating assembly 612 for injection downhole. It will be appreciated that due to the configuration shown, a common drive shaft may be used for the heating assembly 612 as well as any downhole pump 630. Further, the common drive shaft may be used to power any inlet propeller of the fluid heating assembly 612 heater, e.g. used to pressurise fluid in the heating chamber 118.

After fluid has been provided to the fluid heating assembly 612 downhole, the fluid heating assembly 612 is configured to agitate fluid therein, and in particular in the heating chamber 118, so as to impart thermal energy and heat to that fluid. That heated fluid may then be injected into well 600.

In some examples, such imparted heat may be sufficient to cause a phase change within the heating chamber, or shortly after injection from the heating chamber. In such a way, liquid fluid may be communicated to the heater 612 for gas (e.g. steam) to be produced only at the desired location.

In some examples, the arrangement shown in FIG. 5A may be used for injection only. In those cases, the outlet may be removed and replaced with a nozzle 125 only. Further, any production flow path may be occluded.

Figure 5B:
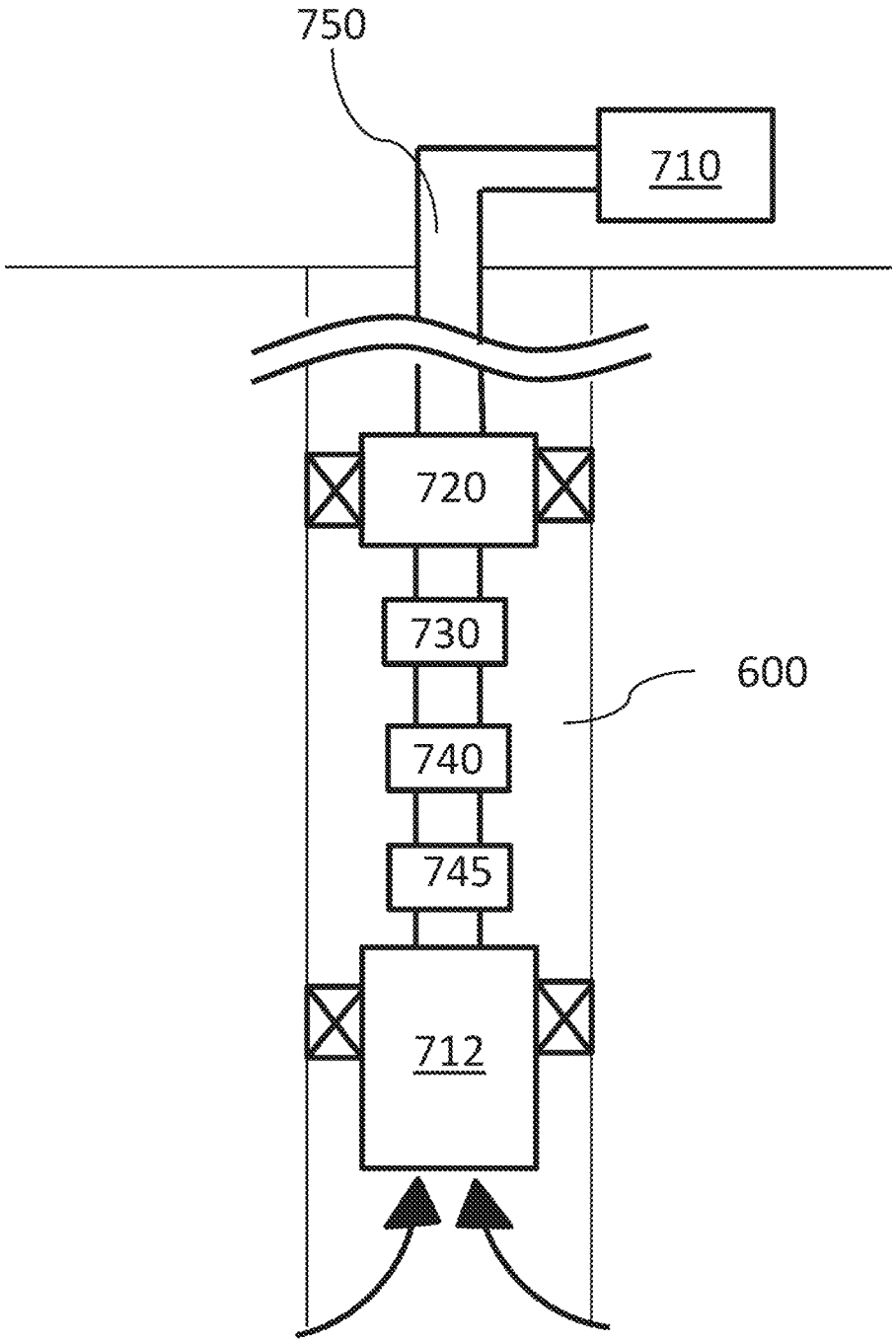

Although not shown, the fluid heating assembly 612 and motor 640 may be located at a location on the surface (e.g. on the topsides of a rig). In this example, the fluid heating assembly 612 may be held in a container of fluid to be heated, and may be used to heat the fluid at a surface location, before the heated fluid is then pumped downhole. In further examples, the fluid heater may be used solely or principally in production mode. Consider now FIG. 5B which shows a simplified representation of deploying a fluid heating assembly 712 downhole in a well 600 during production. Here, the heating assembly 712 is coupled to a downhole motor 745, which is coupled to a sealed chamber section 740, which in turn in coupled to a pump inlet 730 and downhole pump 720. Power cabling 750 connects the downhole arrangement to a controller 710. The power cabling 750 may be, for example, temperature resistant cabling to prevent damage to cabling 750 when used in the downhole environment.

Fluid may be passed to the heating assembly for heating 712 in a similar manner to FIG. 5A. However, in some examples when the heating assembly 712 is in production mode only, a resident fluid may be contained within the heating chamber 118 (e.g. sealed in the heating chamber), such as a high temperature oil or the like. Again, inlets and outlets may be reconfigured as appropriate. In any event, as the heating assembly 712 is operational and fluid is agitated within the heating chamber 118, any product passing in the flow path between the fluid heating assembly 712 and the housing can be heated and the viscosity reduced accordingly, assisting with production to surface.

It will be appreciated that the above heating assembly may be used in injection mode, production mode, or combination thereof. Further, the heating assembly 12, 112, 212, 612, 712 may be reconfigurable between modes of operation (e.g. at surface). While in the examples shown in FIGS. 5A and 5B only a single heating assembly 12, 112, 212, 612, 712 is described, it will be appreciated that a plurality of heating assemblies 12, 112, 212, 612, 712 may also be implemented within the well 600. In any event, the heating assembly 12, 112, 212, 612, 712 may be deployed in a well 600 requiring enhanced oil recovery, and injection and/or production of heated fluids.

During use, agitation of fluid in the fluid heating assembly 12, 112, 212, 612, 712 and in particular the heating chamber 118, imparts thermal energy and heat to that fluid. The heated fluid may then be injected into well 600, and/or used to heat product (e.g. oil) in the well 600.

The fluid heating assembly 12, 112, 212, 612, 712 may be sized as appropriate for the intended task. For example, in a smaller well the fluid heating assembly may have a diameter of 3 inches, and in a larger well may have a diameter of 30 inches. Similarly the length of the fluid heating assembly may vary depending on the intended use, for example from 0.5 m to 20 m.

In this particular example shown, and without wishing to be bound by theory, it is believed that transient flow restrictions in the flow path of the heating assembly upon relative movement between the first and second portions may produce fluid friction with the first and second portions as so increase the fluid temperature before the heat is dissipated from the fluid. Further, transient local fluid restriction (or compression) and relaxation (or decompression) may additionally or alternatively produce local cavitation effects that generate heat upon restoration of pressure within the fluid.

Therefore, the first and second portions may be configured such that upon relative movement between the first and second portions the flow path defined by the first and second portions continuously changes between a flow path cross-section with minimum fluid flow resistance and a flow path cross-section with maximum fluid flow resistance.

Energy may be transferred to the fluid by various mechanisms, such as by friction between the fluid and the moving surfaces within the heating assembly heating chamber, which may increase when the cross-section of the heating chamber is at its maximum flow resistance cross-section, by continuous repetitive pressurisation and depressurisation of the fluid when the heating chamber cross-section continuously changes from its maximum to its minimum flow resistance cross-sections and vice versa. This may also create turbulence in the fluid and by changing the fluid regime from turbulent to laminar and vice versa, when the fluid is forced to pass through narrow restrictions towards broader areas and vice versa.

A heating assembly as described above may be capable of producing an increase in a fluid enthalpy, either in its latent heat or in its sensible heat or both, in remote locations, such as deep oil wells, where only mechanical power is available and therefore obviates the need to transfer hot fluids, such as steam, over great lengths to where difficult and viscous oil may be found and otherwise unfeasible to recover. For example, the heating assembly may be able to reduce the viscosity of a fluid to be transferred, as well as potentially reducing the precipitation of wax from a fluid to be transferred, thereby facilitating transfer (e.g. by pumping) of a fluid to be transferred and therefore increasing the life of fluid transfer components (such as pumps) as well as deferring maintenance of such components and potentially reducing the requirement for well cleaning and chemical/acid dosing.

Such a heating assembly 12, 112, 212, 612, 712 may find application, for example, in Enhanced Oil Recovery operations, where it can be helpful to provide heat on demand at deep downhole locations to reduce the viscosity of the produced fluids, for example by feeding water into the apparatus, which has been previously heated to just below its boiling point, and transforming it to steam in-situ and injecting it at the desired well zone. In other words, fluid may be communicated to the fluid heater at a particular pressure and/or temperature, selected such that the fluid remains in a liquid phase until reaching the heater, but leaves the heater in a gas phase.

Other situations in which such an apparatus may be employed may be during pressurising water for reverse osmosis operations, in which simultaneously to the pressurisation, heating is also desired to avoid salt or scale deposits on the moving elements. It may also be desired to use such an apparatus for heating a fluid which is susceptible to thermal degradation in contact with hot surfaces or when subjected to radiation, for examples fluids containing biological substances, the accidental overheating of which may be cost prohibitive.

The applicant hereby discloses in isolation each individual feature described herein and any combination of two or more such features, to the extent that such features or combinations are capable of being carried out based on the specification as a whole in the light of the common general knowledge of a person skilled in the art, irrespective of whether such features or combinations of features solve any problems disclosed herein, and without limitation to the scope of the claims. The applicant indicates that aspects of the present invention may consist of any such individual feature or combination of features. In view of the foregoing description it will be evident to a person skilled in the art that various modifications may be made within the spirit and scope of the invention.

The invention claimed is:

1. A downhole fluid heater, comprising:

a fluid heating assembly comprising a first portion and a second portion movable relative to one and other, and a heating chamber for receiving a heat transfer fluid, the heating chamber defined between an external chamber surface of the first portion and an internal surface of the second portion, the heating chamber comprising chamber surface features on the external chamber surface of the first portion and internal surface features on the internal surface of the second portion, such that relative movement of the first portion and the second portion cause relative movement of the chamber surface features and the internal surface features;

wherein the fluid heating assembly is configured to agitate the heat transfer fluid in the heating chamber so as to impart thermal energy and heat the heat transfer fluid, and wherein the heating chamber is a sealed volume.

2. The downhole fluid heater according to claim 1, wherein the chamber surface features and/or the internal surface features comprise one or more protrusions, extending from a surface of the first and/or second portion into the heating chamber.

3. The downhole fluid heater according to claim 2, wherein the surface features are configured to extend longitudinally along the surface of the first and second portion, wherein the surface features are evenly spaced on the first and second portions.

4. The downhole fluid heater according to claim 1, wherein the fluid heater comprises an external heat transfer surface configured to be in thermal communication with a fluid to be heated, and the second portion is configured to transfer thermal energy via internal surface features to the external heat transfer surface to increase the thermal energy of the fluid to be heated.

5. The downhole heater according to claim 1 further comprising a housing circumscribing the fluid heating chamber, and wherein a flow path for produced fluid is provided between the housing and the fluid heating assembly, wherein the housing and fluid heating assembly are configured such that heat generated within the fluid heating assembly is transferable to fluid in the flow path.

6. The downhole fluid heater according to claim 5, wherein the flow path comprises a flow path inlet, configured to mitigate particles entering the flow path, and wherein the heater is configured such that fluid flowing within the flow path is counter current to fluid in the heating chamber.

7. The downhole fluid heater according to claim 1, wherein the first portion is configured as a rotor and the second portion is configured as a stator.

8. The downhole fluid heater according to claim 1, wherein the heater is powered by one or more of an electric motor and a hydraulic motor.

9. The downhole heater according to claim 1, wherein the fluid heating assembly is configured to transform liquid to vapour or gas.

10. The downhole fluid heater according to claim 1, wherein the fluid heating assembly is configured for enhanced oil recovery.

11. A method for heating fluid downhole, comprising:

providing a fluid heater downhole, the fluid heater comprising a first portion and a second portion moveable relative to one and other, and a heating chamber for receiving a heat transfer fluid defined between an external chamber surface of the first portion and an internal surface of the second portion, the heating chamber comprising chamber surface features on the chamber surface of the first portion, and comprising internal surface features on the internal surface of the second portion, such that relative movement of the first portion and the second portion cause relative movement of the chamber surface features and the internal surface features; and agitating a heat transfer fluid in the heating chamber of the fluid heating assembly so as to impart thermal energy and heat to the heat transfer fluid, wherein the heating chamber is a sealed volume.

12. The method according to claim 11, further comprising:

providing the heat transfer fluid in the heating chamber; and producing relative movement of the surface features in the heating chamber, and so mechanically agitating the heat transfer fluid in the heating chamber and thus imparting thermal energy and heat to the heat transfer fluid.

13. The method according to claim 11, comprising communicating a fluid produced downhole in a liquid phase to the heater, and injecting said produced fluid in a gas phase from the heater downhole.

14. The method according to claim 11 comprising communicating a fluid produced downhole to the fluid heater at a particular pressure or temperature.

15. The method according to claim 11, comprising using the thermal energy generated at the heater to reduce viscosity of a fluid produced downhole.

* * * * *